US006316129B1

(12) United States Patent
Seki et al.

(10) Patent No.: US 6,316,129 B1
(45) Date of Patent: Nov. 13, 2001

(54) THIN, FORGED MAGNESIUM ALLOY CASING AND METHOD FOR PRODUCING SAME

(75) Inventors: Isao Seki, Niigata-ken; Shigeo Hama, Saitama-ken; Shigehiro Tanike, Niigata-ken; Fukashi Watanabe, Saitama-ken; Masahiko Kakizaki, Tokyo; Shinji Seki, Niigata-ken, all of (JP)

(73) Assignees: Tokyo Seitan Inc., Niigata-ken; Sony Corporation, Tokyo, both of (JP)

( * ) Notice: Subject to any disclaimer, the term of this patent is extended or adjusted under 35 U.S.C. 154(b) by 0 days.

(21) Appl. No.: 09/275,003

(22) Filed: Mar. 24, 1999

(30) Foreign Application Priority Data

| | | |
|---|---|---|
| Mar. 26, 1998 | (JP) | 10-079135 |
| Dec. 28, 1998 | (JP) | 10-372326 |
| Dec. 28, 1998 | (JP) | 10-372327 |
| Dec. 28, 1998 | (JP) | 10-372328 |

(51) Int. Cl.[7] ..... H05K 5/04

(52) U.S. Cl. ..... 428/687; 428/458; 428/469; 428/596; 428/599; 428/600; 361/679; 174/52.4

(58) Field of Search ..... 428/600, 601, 428/469, 596, 599, 687, 458; 361/600, 601, 679; 174/50.54, 52.1, 52.4, 52.5

(56) References Cited

U.S. PATENT DOCUMENTS

| | | | |
|---|---|---|---|
| 4,770,946 | * | 9/1988 | Yamauchi et al. . |
| 4,973,393 | * | 11/1990 | Mino et al. . |
| 5,715,139 | * | 2/1998 | Nakajima . |
| 6,007,925 | * | 12/1999 | Kakizaki et al. . |
| 6,054,174 | * | 4/2000 | Kakizaki et al. . |

FOREIGN PATENT DOCUMENTS

| | | |
|---|---|---|
| 0 767 463 A1 | 4/1997 | (EP) . |
| 3-294036 | 12/1991 | (JP) . |
| A-6-172949 | 3/1994 | (JP) . |
| A-6-55230 | 6/1994 | (JP) . |
| A-6-328155 | 11/1994 | (JP) . |
| 9-263871 | 10/1997 | (JP) . |
| WO 85/03190 | 8/1985 | (WO) . |

OTHER PUBLICATIONS

Naoki Osada (Graduate school of Industrial Technology, Nihon University); Mototsugu Katsuta (College of Industrial Technology, Nihin University), "Deep Drawability of AZ31 Magensium Alloy Sheet;" The 89$^{th}$ Autumn convention of the Light Alloy Association in 1994, pp. 179–180, (No month).

* cited by examiner

*Primary Examiner*—Deborah Jones
*Assistant Examiner*—Jennifer McNeil
(74) *Attorney, Agent, or Firm*—Sughrue, Mion, Zinn, Macpeak & Seas, PLLC

(57) ABSTRACT

A thin, forged magnesium alloy casing is integrally constituted by a thin plate with projections on either or both surfaces, and the thin plate is as thin as about 1.5 mm or less. The thin forged casing can be produced by (a) carrying out a first forging step for roughly forging a magnesium alloy plate to form an intermediate forged product under the conditions of a preheating temperature of the magnesium alloy plate of 350–500° C., a die temperature of 350–450° C., a compression pressure of 3–30 tons/cm$^2$, a compressing speed of 10 . 500 mm/sec. and a compression ratio of 75% or less; and (b) carrying out a second forging step for precisely forging the intermediate forged product under the conditions of a preheating temperature of the intermediate forged product of 300–500° C., a die temperature of 300–400° C., a compression pressure of 1–20 tons/cm$^2$, a compressing speed of 1–200 mm/sec., and a compression ratio of 30% or less.

6 Claims, 8 Drawing Sheets

THIN, FORGED MAGNESIUM ALLOY CASING AND METHOD FOR PRODUCING SAME

BACKGROUND OF THE INVENTION

The present invention relates to a thin, forged magnesium alloy casing suitable as light, strong casings for small electronic appliances and media and a method for producing such a thin forged casing.

Because magnesium has the smallest specific gravity of 1.8 among metal materials put into practical use at present, magnesium alloys are finding wide expectations and applications as light, strong materials alternative to aluminum having a specific gravity of 2.7 and it alloys. Magnesium alloys may be used for parts of aircraft and spacecraft, land transportation equipment, cargo equipment, industrial machines and tools, electronic equipment, telecommunications equipment, agricultural machines, mining machines, office equipment, optical equipment, sports gear, etc.

The magnesium alloys are, however, much poorer in plastic working than aluminum alloys. Accordingly, the magnesium alloys are usually provided as die-castings at present. To improve castability and mechanical strength, magnesium is alloyed with aluminum, zinc, etc. Zirconium may be added to provide strength and toughness, and manganese may be added to make the crystal grains of the magnesium alloys finer. Also, rare earth elements and silver may be added to provide heat resistance.

However, magnesium alloy castings are limited to relatively thick products, because it is extremely difficult to cast magnesium alloys into thin products. In addition, casting defects such as pores and inclusions such as oxides, which are inevitable in casting, may be contained in the magnesium alloy castings and appear on the surface thereof. The casting defects and the inclusions deteriorate the mechanical strength of the magnesium alloy castings, and if they appear on the surface, they adversely affect the corrosion resistance and surface appearance of the castings.

Recently proposed and attracting attention is a so-called semi-solid method for forming magnesium alloy members in a temperature range in which a solid phase and a liquid phase coexist, by utilizing an injection technique. Products obtained by this forming method have fine crystal structures free from dendrites existing in usual castings, and also have higher density with fewer pores than die-castings, whereby they can be subjected to a heat treatment. This method can produce magnesium alloy members as thin as 1.5 mm or less. Nevertheless, the semi-solid, forming method is disadvantageous in that magnesium alloy members produced thereby are not necessarily free from defects and oxide inclusions inside and on the surface. With defects and oxide inclusions, good surface conditions such as appearance and corrosion resistance cannot be obtained.

Another method for forming thin magnesium alloy products is a drawing method. The drawing method comprises casting a magnesium alloy into an ingot; forging the ingot to remove or reduce defects and segregation; cutting or rolling the forged product to a proper length or thickness to form a thin plate; and drawing the thin plate to a desired shape. The drawing method is disclosed in Japanese Patent Laid-Open Nos. 6-55230 and 6-328155, Summary of the 89$^{th}$ Autumn Convention of the Light Alloys Association in 1995, pp. 179–180, etc.

Japanese Patent Laid-Open No. 6-55230 discloses that the deep drawing of a thin magnesium alloy plate can be carried out with a die with a punch and a flange portion heated to a surface temperature of 175–500° C. In the Summary of the 89$^{th}$ Autumn Convention, a 1-mm-thick disc plate made of a magnesium alloy (AZ31) having a diameter of 60–65 mm is subjected to deep drawing with a punch having a radius of 40 mm and a shoulder radius of 12 mm and a die having a cavity having an inner diameter of 43 mm and a shoulder radius of 8 mm, at a blank pressure of 1000 kgf.

The deep drawing method, however, is only applicable to products having smooth surfaces, failing to provide products with projections. In addition, a smaller die shoulder radius than the above would cause cracking in the resultant products at inner bottom edges and corners, failing to provide products with sharp bottom edges and corners.

Because electronic circuits and elements are highly integrated and made denser recently, miniaturization and weight reduction are widely pursued in many applications such as mobile telecommunications gear such as cellular phones, note-type or mobile personal computers, electronic recording media such as compact disks, minidisks, etc. Casings for these appliances and media are mostly made of aluminum alloys at present, though further weight reduction is desired while keeping mechanical strength equivalent to or more than that of aluminum alloys. Magnesium alloys are promising because of their small specific gravity and high mechanical strength, if they can be forged into thin casings with sharp bottom edges, comers and projections.

Japanese Patent Laid-Open No. 6-172949 discloses a magnesium alloy part such as an automobile wheel, etc., and a forging method for producing such a magnesium alloy part. This forging method comprises (a) forging a magnesium alloy casting at a temperature of 300–420° C. to form a forged part having an average crystal size of 100 $\mu$m or less; and (b) subjecting the forged part to a $T_6$ heat treatment comprising a solution treatment and an aging treatment. The forged part is subjected to finish working such as spinning and rolling. In a specific example, the above forging step (a) is carried out under the conditions that the magnesium alloy casting is heated at 400° C., the die is heated at 250° C., and the forging speed is 10 mm/sec. With an average crystal size of 100 $\mu$m or less, the forged magnesium alloy has improved corrosion resistance and mechanical strength.

The technology proposed by Japanese Patent Laid-Open No. 6-172949 is, however, aimed at large, thick parts such as automobile wheels, etc., not coping with difficulty in forging extremely thin products with sharp bottom edges, corners and projections. It also requires the $T_6$ heat treatment that takes a long period of time. If the technology of Japanese Patent Laid-Open No. 6-172949 is applied to forged casings of magnesium alloys, the resultant forged casings would not be able to be made as thin as 1.5 mm or less with sharp bottom edges, corners and projections, because the die at 250° C. cools the magnesium alloy body too low to achieve smooth plastic flow (metal flow) of magnesium alloys during the forging.

OBJECT AND SUMMARY OF THE INVENTION

Accordingly, an object of the present invention is to provide a light, thin, forged magnesium alloy casing with sharp bottom edges, corners and projections.

Another object of the present invention is to provide a light, thin, forged magnesium alloy casing with sharp bottom edges, corners and projections and substantially free from flow marks on the surface.

A further object of the present invention is to provide a method for producing such a light, thin, forged magnesium alloy casing precisely and inexpensively.

As a result of research in view of the above objects, the inventors have found the following facts leading to the completion of the present invention:

(1) Smooth metal flow can be achieved during the forging, if the magnesium alloy body to be forged is heated to a temperature near its melting point, while ensuring that the magnesium alloy is not melted locally by heat generated by strong friction.

(2) When the magnesium alloy is forged at a large compression ratio, remarkable flow marks appear on the surface of the resultant forged products.

(3) When a thin magnesium alloy plate is subjected to rough forging at a limited compression ratio, the surfaces of the magnesium alloy plate in contact with the die surface do not substantially flow, only the inside of the magnesium alloy plate plastically flows laterally. As a result, good surface conditions of the magnesium alloy plate are maintained.

Thus, the present invention provides a thin forged casing integrally constituted by a thin plate with projections on either or both surfaces, the plate being as thin as 1.5 mm or less. The thin plate constituting the thin forged casing is preferably as thin as 1 mm or less.

In a preferred embodiment, the thin forged casing is substantially free from flow marks on the surface.

In another preferred embodiment, the thin forged casing has sharp bottom edges and corners whose inner surfaces have radii of curvature of about 2 mm or less, particularly about 1 mm or less, and sharp projections whose shoulders have radii of curvature of about 2 mm or less, particularly 1 mm or less.

The present invention further provides a method for producing a thin, forged magnesium alloy casing comprising carrying out forging by at least two steps, a first forging step being to roughly forge a magnesium alloy body preheated at 350–500° C. with a first die heated at 350–450° C. to form an intermediate forged product; and a second forging step being to precisely forge the intermediate forged product preheated at 300–500° C. with a second die heated at 300–400° C.

In a preferred embodiment, the method for producing a thin, forged magnesium alloy casing integrally constituted by a thin plate of 1.5 mm or less in thickness with projections on either or both surfaces comprises (a) carrying out a first forging step for roughly forging a magnesium alloy plate preheated at 350–500° C. with a first die heated at 350–450° C. to form an intermediate forged product at a compression ratio of 75% or less; and (b) carrying out a second forging step for precisely forging the intermediate forged product preheated at 300–500° C. with a second die heated at 300–400° C. at a compression ratio of 30% or less.

The magnesium alloy plate to be roughly forged preferably has a thickness of about 3 mm or less. The first forging step is preferably carried out at a compression pressure of 3–30 tons/cm$^2$ and a compression speed of 10–500 mm/sec. The second forging step is preferably carried out at a compression pressure of 1–20 tons/cm$^2$ and a compression speed of 1–200 mm/sec.

DETAILED DESCRIPTION OF THE PREFERRED EMBODIMENTS

[1] Magnesium Alloys

The magnesium alloy for use in the present invention should have excellent forgeability to form a thin casing with sharp bottom edges, corners and projections whose inner surfaces preferably have radii of curvature of about 2 mm or less, particularly about 1 mm or less. Thus, the magnesium alloy used in the present invention has a composition of 1–6 weight % of Al, 0–2 weight % of Zn and 0.5 weight % or less of Mn, the balance being substantially Mg and inevitable impurities.

When the amount of aluminum is less than 1 weight %, the magnesium alloy has poor toughness, though it is well forgeable. On the other hand, when the amount of aluminum is more than 6 weight %, the magnesium alloy has poor forgeability and corrosion resistance. The preferred amount of aluminum is 2–4 weight %, particularly about 3 weight %.

Zinc has similar effects as those of aluminum. From the aspect of forgeability and metal flow, Zn should be 0–2 weight %. The preferred amount of Zn is 0–1 weight %.

If added in a small amount, Mn functions to improve the microstructure of the magnesium alloys. From the aspect of mechanical properties, Mn should be 0.5 weight % or less.

The magnesium alloy may contain other elements such as rare earth elements, lithium, zirconium, etc., in such amounts as not to adversely affect the forgeability, mechanical strength, etc. of the magnesium alloys, usually in a total amount as small as 0.2 weight % or less.

The magnesium alloys satisfying the above composition requirements are commercially available as AZ31 (Al: about 3 weight %, Zn: about 1 weight %, Mn: 0.2–0.3 weight %, Mg and inevitable impurities:

balance), AM20 (Al: about 2 weight %, Mn: about 0.5 weight %, Mg and inevitable impurities: balance), etc., in ASTM.

[2] Production of Thin Forged Casing

The magnesium alloy body is preferably formed into a thin forged casing by at least two steps. In a preferred embodiment, the forging comprises a first forging step and a second forging step. If necessary, a further forging step may be added between the first and second forging steps.

(1) First Forging Step (a) Shape of Magnesium Alloy Body

Figure 1:
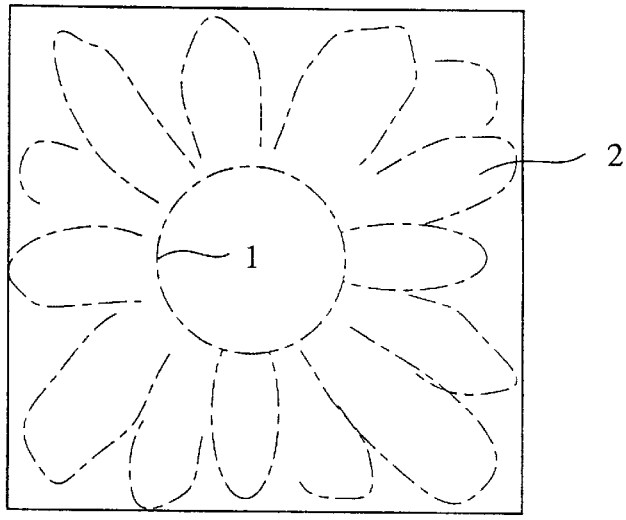
FIG. 1 is a schematic view showing the flow marks appearing on the forged product.

The magnesium alloy body may be in any shape such as rectangular parallelepiped, cylinder, etc., as long as it is forgeable to a desired shape. However, it has been found that when the magnesium alloy body is in a thick bulk shape, the resultant forged product has flow marks on the surface. The term "flow marks" means marks indicating traces of plastic flow of the magnesium alloy occurring during the forging process. FIG. 1 shows an example of flow marks formed when a magnesium alloy in a round cylindrical shape is forged. In FIG. 1, 1 indicates a periphery of the round magnesium alloy cylinder, and 2 indicates so-called flow marks that are traces of plastic flow of the magnesium alloy.

Research has revealed that when a thin magnesium alloy body is forged at a low compression ratio, the flow marks can be suppressed, because disturbed plastic flow does not occur at a low compression ratio. The term "compression ratio" used herein means a ratio (percentage) expressed by the formula: $[(t_0-t_f)/t_0]\times 100\%$, wherein $t_0$ is an original thickness of the magnesium alloy body to be forged, and $t_f$ is a thickness of the forged product.

Figure 2:
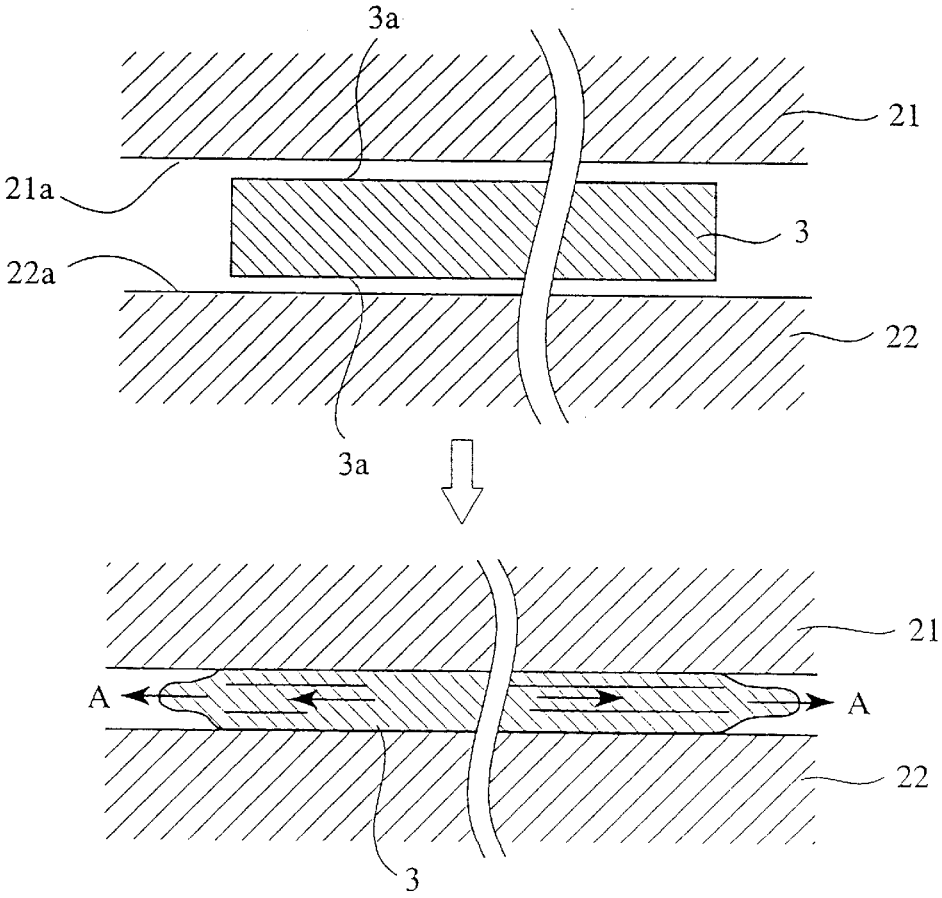
FIG. 2 is a schematic view showing the metal flow of the magnesium alloy in the forging method of the present invention.

The mechanism of plastic flow of the magnesium alloy without causing flow marks is shown in FIG. 2, in which a thin magnesium alloy plate 3 is forged between a pair of die blocks 21, 22. Because both surfaces 3*a*, 3*a* of the magnesium alloy plate 3 are in close contact with the die surfaces 21*a*, 22*a* when compressed by the die blocks 21, 22, both surfaces 3*a*, 3*a* of the magnesium alloy plate 3 do not substantially flow during the forging process. Only an inner portion of the magnesium alloy plate 3 plastically flows laterally as shown by the arrows A, A in FIG. 2.

It has been found that a compression ratio is preferably within 75% in the first forging step and within 30% in the second forging step to sufficiently suppress the flow marks on the resultant thin forged casings. To achieve the above compression ratios, the magnesium alloy body is preferably in a thin plate shape having a thickness of about 3 mm or less. With such a thin magnesium alloy plate, the above mechanism of plastic flow can be utilized to produce a thin forged casing with no flow marks. Because the original surface conditions of the magnesium alloy plates are substantially kept on the forged products, it is preferable to use the magnesium alloy plates with extremely small surface roughness. Incidentally, in the case of a round magnesium alloy rod, the compression ratio may usually be more than 80%.

Particularly in the case of forming a forged casing of about 1.5 mm or less in thickness with an anodic oxidation coating for exhibiting metallic glow, it is important to forge a thin magnesium alloy plate of about 3 mm or less, preferably about 2 mm or less, particularly about 1–1.5 mm in thickness.

Though the size of the magnesium alloy plate may be determined depending on the compression ratio, it is preferable that the magnesium alloy plate is equal to or slightly larger than a bottom area of the final thin forged casing. When the magnesium alloy plate is too large, the resultant thin forged casings are likely to have wrinkles at bottom edges and corners, lowering the yield of the final products. On the other hand, when the magnesium alloy plate is too small, the resultant thin forged casings are unlikely to be uniform in thickness in peripheries.

(b) Preheating of Magnesium Alloy Body

The magnesium alloy body to be forged is first preheated uniformly at a temperature of 350–500° C., slightly higher than the forging temperature of the magnesium alloy body. The preheating temperature of the magnesium alloy body is defined herein as a temperature of atmosphere inside an electric furnace in which the magnesium alloy body is heated. The preheated magnesium alloy body usually cools by about 50° C. while it is taken out of the electric furnace and placed ready for forging in a die. Accordingly, the preheating temperature of the magnesium alloy body is usually about 50° C. higher than the forging temperature.

If the preheating temperature is lower than 350° C., the magnesium alloy does not smoothly flow in the die cavity during the forging process, failing to make the thickness of the resultant forged casing as small as about 1.5 mm or less. On the other hand, if the preheating temperature is higher than 500° C., the magnesium alloy body would be totally or partly melted, resulting in extreme metal flow marks appearing on the surface, which makes it impossible to obtain a thin forged casing with high quality. Also, a higher temperature may cause excessive oxidation and even burning of the magnesium alloy during the forging process. The preferred preheating temperature of the magnesium alloy body is 350–450° C., particularly 400–450° C.

If the magnesium alloy body is heated in the air, a surface of the magnesium alloy body is severely oxidized, adversely affecting the forgeability, corrosion resistance and surface appearance of the resultant thin forged casing. Accordingly, the preheating of the magnesium alloy body should be carried out in vacuum or in an inert gas atmosphere such as an argon gas, etc.

The preheating time is determined depending on the size of the magnesium alloy body. For instance, it is about 10–20 minutes for a cylindrical magnesium alloy body of 30 mm in diameter and 10–30 mm in length. If the magnesium alloy body were in a thin plate shape of about 3 mm or less in thickness, the preheating time would be sufficient to be as short as 5–15 minutes.

(c) Forging Conditions

The first forging step may be carried out on the magnesium alloy body under conditions of a die temperature of 350–450° C., a compression pressure of 3–30 tons/cm$^2$, a compressing speed of 10–500 mm/sec., and a compression ratio of 75% or less.

The die temperature is almost equal to the first forging temperature. When the die temperature is lower than 350° C., the preheated magnesium alloy body is so cooled by contact with the die that sufficient metal flow cannot be achieved during the first forging step, resulting in rough forged surface. On the other hand, when the die temperature is higher than 450° C., the forged product cannot easily be removed from the die. The preferred die temperature is 360–420° C. It should be noted that the first forging temperature is about 50–80° C. lower than a temperature at which the magnesium alloy starts melting to prevent the magnesium alloy from melting locally during the first forging step.

The pressure at which the magnesium alloy body is compressed by a pair of die blocks is 3 tons/cm$^2$ or more. When the compression pressure is less than 3 tons/cm$^2$, the resultant intermediate forged product cannot be made fully thin. The upper limit of the compression pressure may usually be determined depending on the compression ratio. Further, too high compression pressure would cause damage to bottom edges, etc. of the die. In addition, even though the compression pressure exceeds 30 tons/cm$^2$, further improvements in the quality of the forged products cannot be obtained. Accordingly, the upper limit of the compression pressure may be 30 tons/cm$^2$. The preferred compression pressure in the first forging step is 5–25 tons/cm$^2$.

The compressing speed of the magnesium alloy body may be 10–500 mm/sec. When the compressing speed is less than 10 mm/sec, the productivity of the intermediate forged products is too low. On the other hand, when the compressing speed is more than 500 mm/sec., metal flow cannot follow the compression of the magnesium alloy body, resulting in disturbed metal flow, which leads to extreme flow marks on the surface. The preferred compression speed in the first forging step is 50–300 mm/sec.

The compression ratio is preferably within 75% in the first forging step to sufficiently suppress the flow marks on the resultant intermediate forged products. If the compression ratio exceeds 75%, it would be difficult to prevent the flow marks from appearing on the surfaces of the resultant intermediate forged products. The more preferred compression ratio in the first forging step is 50–50%, particularly 18–45%.

Figure 3:
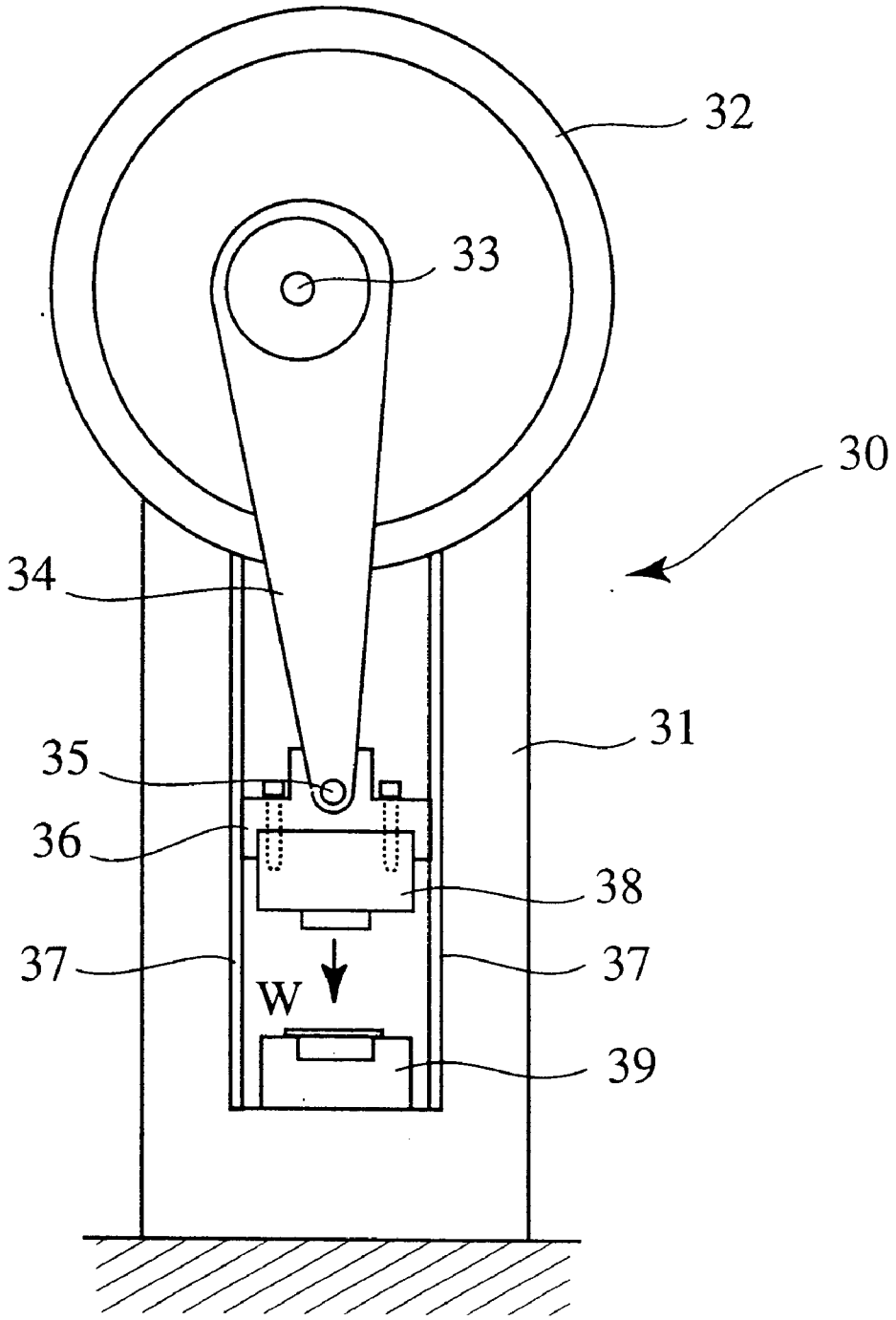
FIG. 3 is a schematic side view showing a forging machine for producing the thin forged casing of the present invention.

The forging may be carried out mechanically or hydraulically. FIG. 3 shows a typical example of the forging machine for carrying out the forging method of the present invention. The forging machine 30, which is operable by a mechanical force, comprises a support frame 31 for rotatably supporting a flywheel 32 rotated by a motor (not shown). Eccentrically connected to the flywheel 32 is a shaft 33 rotatably supported by an upper end of a connecting rod 34, and a shaft 35 rotatably supported by a lower end of the connecting rod 34 is rotatably connected to a movable support 36. The movable support 36 is movable up and down along guides 37, 37 mounted to support frame 31. An upper die block 38 is fixed to the movable support 36, and a lower die block 39 is fixed to a floor of the support frame 31. The upper die block 38 and the lower die block 39 are vertically aligned with each other to define a cavity for forging the magnesium alloy body W.

Figure 4:
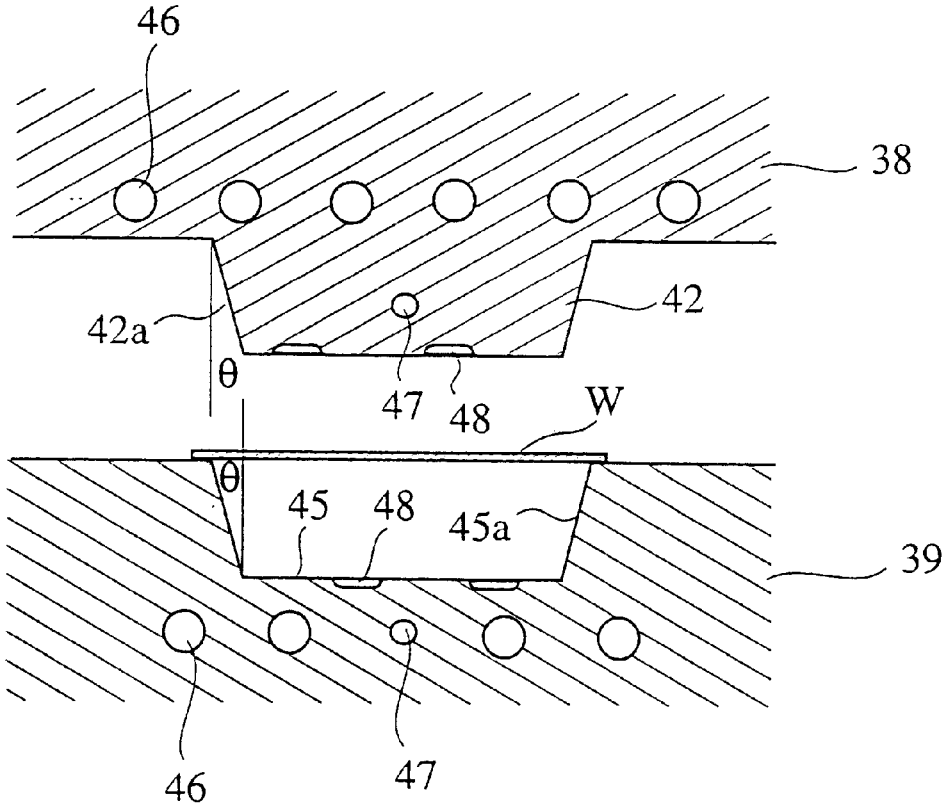
FIG. 4 is a vertical, cross-sectional view showing a pair of die blocks disposed vertically for carrying out the first forging step of the present invention.

As shown in FIG. 4, the upper die block 38 may have a punch portion 42, and the lower die block 39 may have a cavity 45 for receiving the punch portion 42 to define a space in which the magnesium alloy body W is roughly forged. Each die block 38, 39 has a heater 46 and a thermocouple 47. The punch portion 42 and the cavity 45 have sidewalls 42*a*, 45*a* slanting at a larger angle θ than those of the second forging die to ensure smooth metal flow in the first forging step. At least one of the punch portion 42 and the cavity 45 has recesses 48 for forming projections on at least one surface of the intermediate forged product. The recesses 48 are generally in dull shape for smooth metal flow. Thus, the resultant intermediate forged product has a similar shape to that of the final, thin forged casing and having bottom edges, corners and projections having larger radii of curvature.

Figure 5:
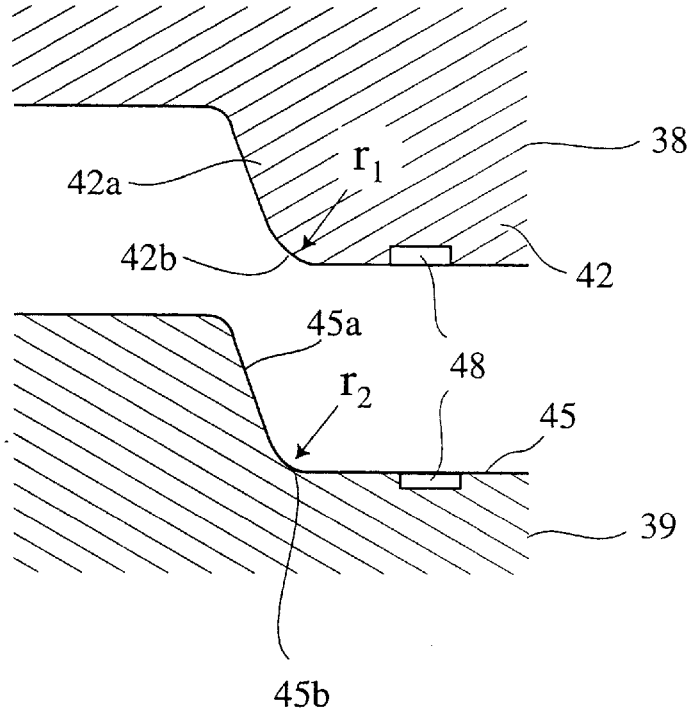
FIG. 5 is a partial, vertical, cross-sectional view showing edge areas of the die blocks of the first forging die, which are in an open state.
Figure 6:
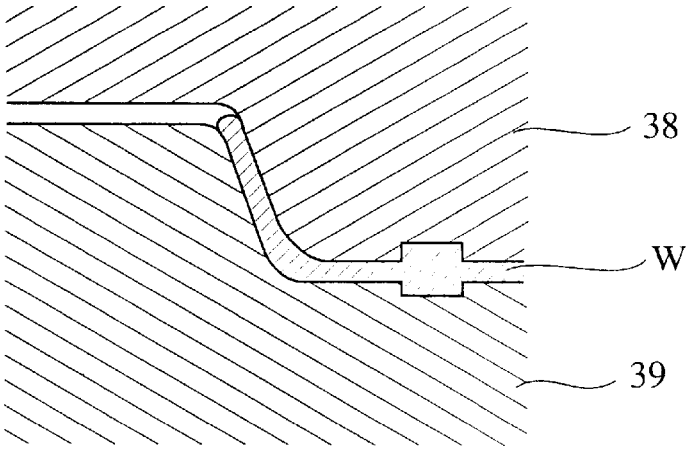
FIG. 6 is a partial, vertical, cross-sectional view showing edge areas of the die blocks of the first forging die, which are in a closed state.

As shown in FIG. 5, the shoulders 42*b* of the punch portion 42 and the bottom edges 45*b* of the cavity 45 preferably have relatively large radii of curvature $r_1$, and $r_2$, respectively. In a preferred embodiment, the radius of curvature $r_1$ is 1 mm or more, particularly 2–7 mm, and the radius of curvature $r_2$ is 0.5 mm or more, particularly 0.5–2 mm. With such radii of curvature $r_1$ and $r_2$, smooth metal flow can be achieved in the bottom edge regions as shown in FIG. 6.

(2) Second Forging Step (a) Preheating of Intermediate Forged Product

The intermediate forged product obtained in the first forging step is preheated uniformly at a temperature of 300–500° C. in vacuum or in an inert gas atmosphere such as an argon gas, etc. If the preheating temperature of the intermediate forged product is lower than 300° C., smooth metal flow does not occur along the cavity surface of the forging die during the second forging step, failing to transfer precisely the cavity surface contour of the second forging die to the final thin forged casing. On the other hand, if the preheating temperature is higher than 500° C., the intermediate forged product may be melted in portions subjected to strong friction, resulting in extreme flow marks appearing on the surface. The preferred preheating temperature of the intermediate forged product is 350–450° C.

The preheating time of the intermediate forged product is also determined depending on the size of the intermediate forged product. For instance, it is about 5–15 minutes for the intermediate forged product of 1 mm in thickness.

(b) Forging Conditions

The second forging step is preferably carried out on the intermediate forged product under the conditions of a die temperature of 300–400° C., a compression pressure of 1–20 tons/cm$^2$, a compressing speed of 1–200 mm/sec., and a compression ratio of 30% or less.

The die temperature is almost equal to the second forging temperature that may be slightly lower than the first forging temperature because the compression ratio is smaller in the second forging step than in the first forging step. When the die temperature is lower than 300° C., the preheated intermediate forged product is so cooled by contact with the die that cavity surface contour cannot be precisely transferred from the second forging die to the resultant thin forged casing by the second forging step. On the other hand, when the die temperature is higher than 400° C., the forged product cannot easily be removed from the die. The preferred second die temperature is 330–400° C.

The compression pressure in the second forging step may be smaller than in the first forging step, and is preferably 1–20 tons/cm$^2$. When the compression pressure is less than 1 tons/cm$^2$, the resultant forged casing cannot be made fully thin with excellent surface contour. On the other hand, when the compression pressure exceeds 20 tons/cm$^2$, further improvements in the quality of the forged products cannot be obtained. The preferred compression pressure in the second forging step is 5–15 tons/cm$^2$.

The compressing speed of the intermediate forged product may be 1–200 mm/sec. When the compressing speed is less than 1 mm/sec, the productivity of the forged casings is too low. On the other hand, when the compressing speed is more than 200 mm/sec., the cavity surface contour of the second forging die cannot be precisely transferred to the thin forged casing, failing to provide the thin forged casing with excellent surface conditions. The preferred compression speed in the second forging step is 20–100 mm/sec.

The compression ratio is preferably within 30% in the second forging step to sufficiently suppress the flow marks on the resultant thin forged casings. If the compression ratio exceeds 30%, it would be difficult to prevent the flow marks from appearing on the surfaces of the resultant thin forged casings. The more preferred compression ratio in the second forging step is 5–20%.

Figure 7:
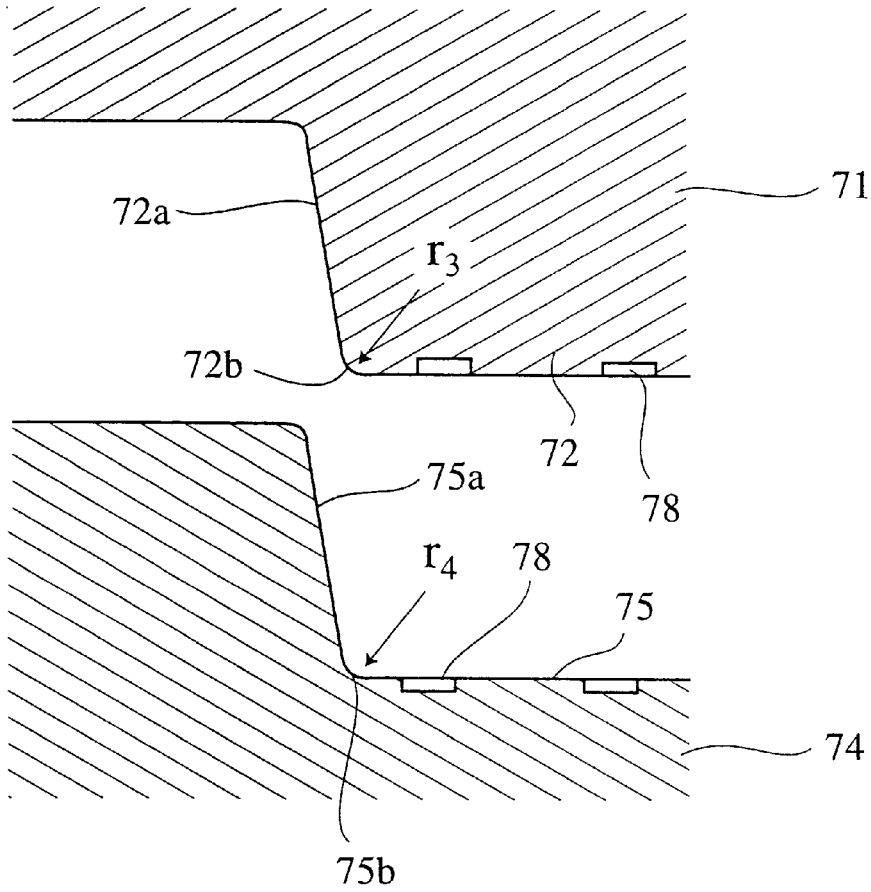
FIG. 7 is a partial, vertical, cross-sectional view showing edge areas of the die blocks of the second forging die, which are in an open state.

As shown in FIG. 7, the second forging die may consist of an upper die block 71 having a punch portion 72, and a lower die block 74 having a cavity 75 for receiving the punch portion 72 to define a space in which the intermediate forged product is forged. It should be noted that sidewalls 72*a*, 75*a* of the punch portion 72 and the cavity 75 are depicted as being exaggeratively inclined, and that their inclinations are smaller than those of the first forging die. The punch portion 72 and the cavity 75 have small recesses 78 for forming projections on either or both surfaces of the thin forged casing. The shoulders 72*b* have a relatively small radius of curvature $r_3$, and the bottom edges 75*b* have a relatively small radius of curvature $r_4$. In a preferred embodiment, the radius of curvature $r_3$ is 1 mm or less, and the radius of curvature $r_4$ is 1 mm or less.

A ratio of $r_1/r_3$ is preferably 2–7, and a ratio of $r_2/r_4$ is preferably 2–7. When the ratios of $r_1/r_3$ and $r_2/r_4$ are less than 2, smooth metal flow cannot be achieved. On the other hand, when the ratios of $r_1/r_3$ and $r_2/r_4$ exceed 7, a large compression ratio is needed in the second forging step, failing to provide the final, thin, forged casing with sharp edges and corners without flow marks.

The same forging machine as in the first forging step may be used for the second forging step, except that the die should have precisely the same surface contour as that of the final casing.

[3] Thin Forged Casing

Figure 8:
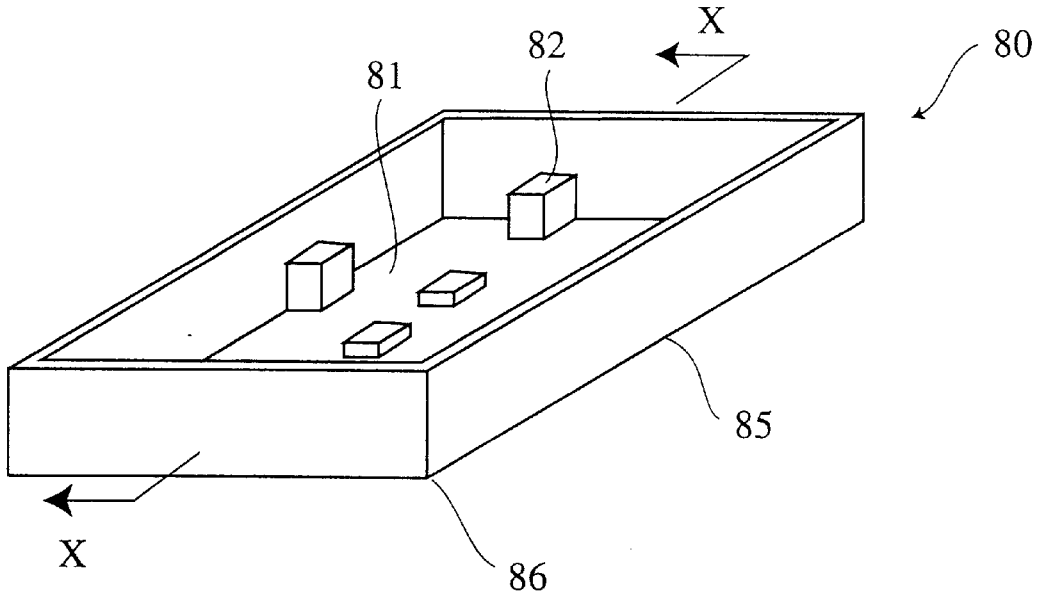
FIG. 8 is a perspective view showing a typical example of the thin forged casing of the present invention.
Figure 9:
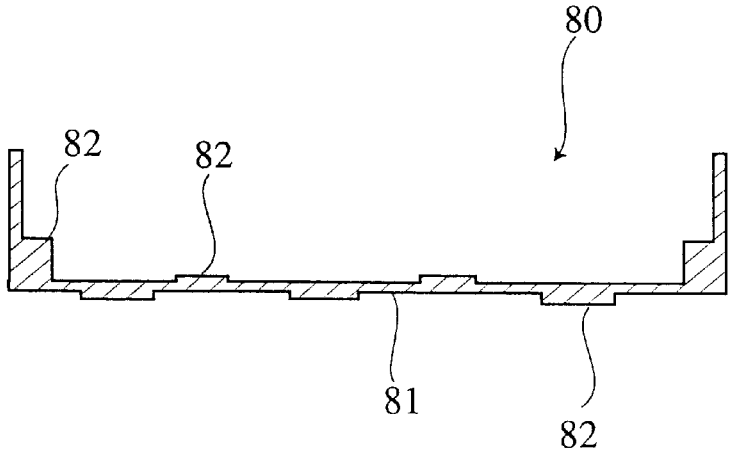
FIG. 9 is a cross-sectional view taken along the line X—X in FIG. 8.

As schematically shown in FIGS. 8 and 9, the thin forged casing 80 of the present invention may be constituted by a box-shaped, thin plate 81 that has projections 82 of various heights on either or both surfaces. The thickness of the thin plate 81 in areas without projections 82 is preferably as small as about 1.5 mm or less, more preferably about 1 mm or less. The projections 82 may be bosses for screw holes, projections indicating alphabets, numbers and/or symbols, etc. Of course, the thin plate portion 81 may have thinner regions than the remainder unless the thinner regions affect the mechanical strength of the thin forged casing 80.

The thin forged casing of the present invention preferably has sharp bottom edges, corners and projections. Particularly in the case of small casings, for instance, those of minidisks, the inner surfaces of bottom edges 85 and corners 86 preferably have radii of curvature of 1 mm or less. Sharp bottom edges, corners and projections whose inner surfaces have such small radii of curvature can be provided only by the forging method of the present invention.

The resultant thin forged casing is trimmed at sidewalls by a cutter, etc. such that the sidewalls have exactly the same height. If necessary, screw bores may be formed in the boss projections. The thin forged casing may then be polished.

[4] Surface Coating

After polishing, the thin forged casing may be subjected to a surface coating such as an anodic oxidation coating, a paint coating, etc.

The anodic oxidation coating can be carried out according to JIS H 8651. An electrolytic solution for anodic oxidation may have a composition comprising one or more of sodium dichromate, acidic sodium fluoride, acidic potassium fluoride, acidic ammonium fluoride, ammonium nitrate, sodium dihydrogenphosphate, ammonia water, etc. The electrolytic components may preferably be combined depending on the composition of the magnesium alloy, the desired color of the thin forged casing, etc. Because the anodic oxidation conditions per se are known in the art, their explanations will be omitted here.

Because the anodic oxidation coating is generally transparent with or without tint, the anodized thin forged casing keeps metallic gloss inherent in the magnesium alloy.

Though the paint coating may be carried out with any paint, it is preferable to coat a clear paint if metallic gloss is desired. The clear paint may be made of thermosetting acrylic resins, polyester resins, epoxy resins, etc. without or trace of pigments like clear coatings of automobiles, etc. Before coating, the thin forged casing is preferably subjected to a chemical treatment with zinc phosphates, zinc chromates, etc.

Figure 10:
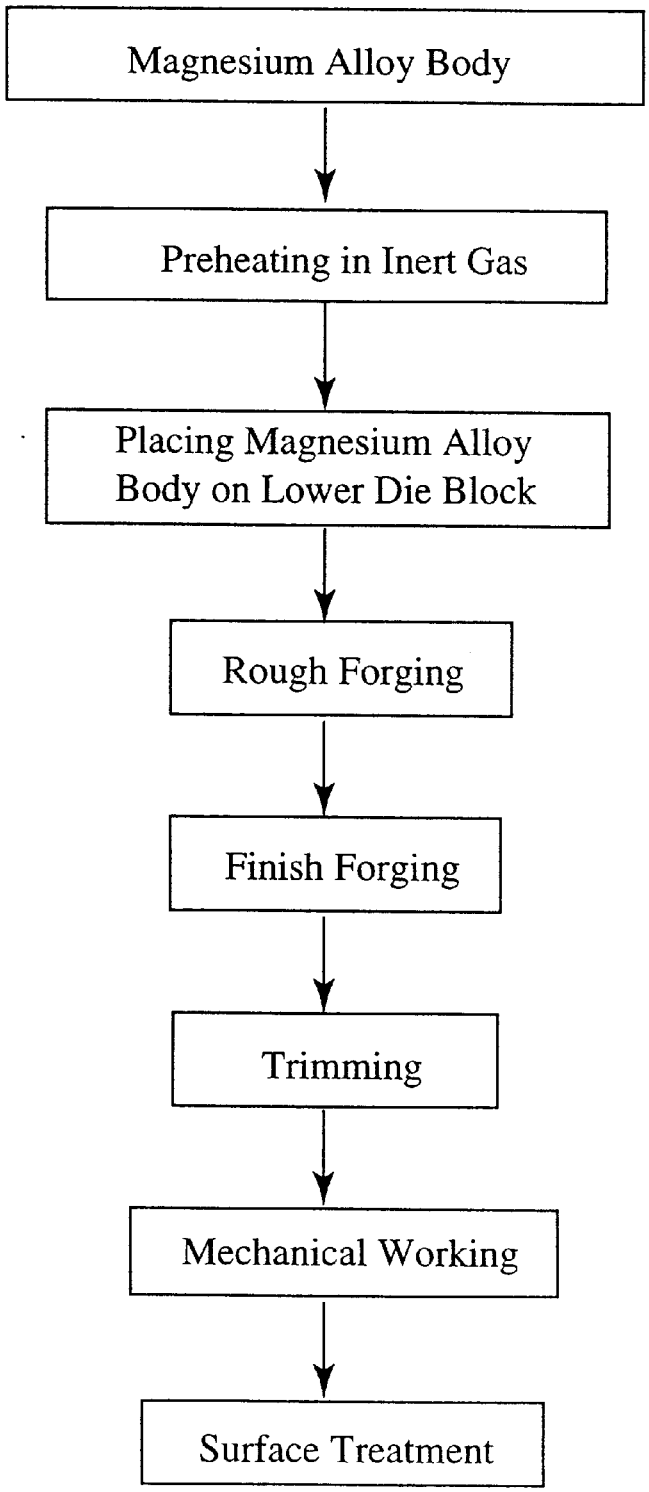
FIG. 10 is a flow chart showing a typical example of the forging steps of the present invention.

FIG. 10 is a flow chart showing the entire steps of the forging method according to a preferred embodiment of the present invention.

The present invention will be described in detail referring to the following without intention of limiting the present invention thereto.

EXAMPLE 1

Ten round magnesium alloy rods (AZ31) of 30–40 mm in diameter and 10–40 mm in length were preheated at 500° C. and placed in a first forging die shown in FIG. 4, which were coated with a graphite lubricant and heated at 400° C. The first forging step was carried out under the conditions of a compression speed of 200 mm/sec. and a compression pressure of 20 tons/cm$^2$ to form intermediate forged products having a thickness of 0.8–1.0 mm in a flat, thin plate area.

Next, each intermediate forged product was heated at 400° C. and subjected to a second forging step under the conditions of a die temperature of 350° C., a compression speed of 50 mm/sec. and a compression pressure of 10 tons/cm$^2$ to form a box-shaped, thin forged casing. After trimming sidewalls, removal of the lubricant and polishing were carried out. The resultant thin forged casing had a size as follows:

Bottom: 80 mm×80 mm,

Sidewall: 5 mm (height),

Thickness: 0.6–0.8 mm (flat plate portion), and

Radius of curvature at inner bottom edges: 1 mm.

Observing the thin forged casing by the naked eye to examine defects (pores and oxide inclusions), it was found that the thin forged casing had an extremely uniform surface structure without defects.

Comparative Example 1

The same round magnesium alloy rod (AZ31) as in EXAMPLE 1 was subjected to a first forging step under the same conditions as in EXAMPLE 1 except that the die temperature was set at 300° C. As a result, an intermediate forged product having a flat plate portion of more than 1.6 mm in thickness was formed. Next, the same second forging step as in EXAMPLE 1 was carried out to form a thin forged casing having a flat plate portion of 1.5 mm in thickness. This result verifies that when the first forging step is carried out at a die temperature as low as 300° C., the magnesium alloy body is too cooled in contact with the low-temperature forging die, making plastic flow (metal flow) uneasy. When the intermediate forged product is too thick, it is difficult to provide the forged casing with a small thickness in the second forging step.

Comparative Example 2

The first forging step was carried out on the same round magnesium alloy rod under the same conditions as in EXAMPLE 1 except for a preheating temperature of 340° C. and a compression pressure of 30 tons/cm$^2$. As a result, an intermediate forged product having a flat plate portion of more than 1.8 mm in thickness was obtained. Next, the same second forging step as in EXAMPLE 1 was carried out, resulting in a forged casing having a flat plate portion of more than 1.6 mm in thickness. This result verifies that when the preheating temperature is too low, sufficient metal flow cannot be achieved even with as high a compression pressure as 30 tons/cm$^2$.

Comparative Example 3

The first forging step was carried out on the same round magnesium alloy rod under the same conditions as in EXAMPLE 1 except for a preheating temperature of 560° C. The resultant intermediate forged product had metal flow marks on the surface due to the high preheating temperature, though it was made as thin as 1.0 mm or less in a flat plate portion. Next, the second forging step was carried out under various conditions, resulting in a thin forged casing with metal flow marks on the surface. This result verifies that when the forging temperature is too high, it is impossible to produce thin forged casings without metal flow marks on the surface.

Comparative Example 4

The first forging step was carried out on the same round magnesium alloy rod under the same conditions as in EXAMPLE 1 except for a compression pressure of 0.8 tons/cm$^2$. The resultant intermediate forged product had a thickness more than 2.0 mm. Next, the second forging step was carried out under various conditions, particularly at a compression pressure of 30 tons/cm$^2$ or 40 tons/cm$^2$, in an attempt to form a forged casing as thin as 1.0 mm. However, the resultant thin forged casing had an uneven thickness, proving that the above intermediate forged product was not well forgeable.

Comparative Example 5

The first forging step was carried out on the same round magnesium alloy rod under the same conditions as in EXAMPLE 1 except for a compression speed of 500 mm/sec. The plastic flow (metal flow) was disturbed, failing to achieve good filling of the magnesium alloy into the die cavity for precise forging. Also, when the compression speed was less than 10 mm/sec., too much time passed to complete the first forging step, resulting in too much decrease in the forging temperature. When the compression speed was less than 5 mm/sec., the resultant forged casing was as thick as 2.5 mm.

EXAMPLE 2

This EXAMPLE used a first forging die consisting of a lower die block having a cavity whose inner bottom edges had a radius of curvature of 0.6 mm and an upper die block having a punch portion whose shoulder had a radius of curvature of 2.5 mm, and a second forging die consisting of a lower die block having a cavity whose inner bottom edges had a radius of curvature of 0.6 mm, and an upper die block having a punch portion whose shoulder had a radius of curvature of 0.7 mm.

Figure 11:
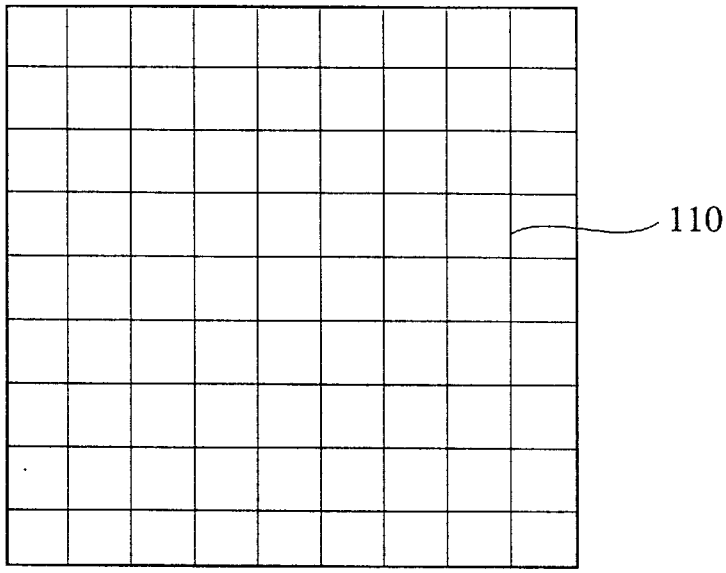
FIG. 11 is a plan view showing lines depicted on the surface of the magnesium alloy plate to be forged.

A thin, flat magnesium alloy plate (AZ31) of 100 mm×100 mm×1.0 mm, which had lines 110 in a checkerboard pattern as shown in FIG. 11, was uniformly preheated at 450° C. in an electric furnace filled with an argon gas and placed in a first forging die heated at 400° C. The first forging step was carried out for rough forging under the conditions of a compression speed of 200 mm/sec., a compression pressure of 10 tons/cm$^2$ and a compression ratio of 30%. The resultant box-shaped, intermediate forged product had a bottom of 95 mm×95 mm, sidewalls having an effective height of 8 mm, and a thickness of 0.7 mm in a flat plate portion without any defects and flow marks on the surface.

Next, the intermediate forged product was heated at 400° C. in an electric furnace filled with an argon gas and placed in a second forging die heated at 350° C. The intermediate forged product was subjected to a second forging step for precise forging under the conditions of a compression speed of 50 mm/sec. a compression pressure of 10 tons/cm$^2$, and a compression ratio of about 14%. After trimming sidewalls, removal of the lubricant and polishing were carried out. The resultant box-shaped, thin forged casing had the following size:

Bottom: 95 mm×95 mm,

Sidewalls: 8 mm,

Thickness: 0.6 mm (flat plate portion), and

Radius of curvature at inner bottom edges: 0.7 mm.

As a result of observing by the naked eye, it was found that the lines 110 depicted on the surface were not substantially disturbed. It was also found that the thin forged casing had an extremely uniform surface metal structure free from defects such as pores and oxide inclusions, and flow marks.

EXAMPLE 3

This EXAMPLE used a first forging die consisting of a lower die block having a cavity whose inner bottom edges had a radius of curvature of 0.8 mm and an upper die block having a punch portion whose shoulder had a radius of curvature of 3.5 mm.

A thin, flat magnesium alloy plate (AZ31) of 55 mm×160 mm×1.5 mm was uniformly preheated at a temperature ranging from 200° C. to 550° C. in an electric furnace filled with an argon gas and placed in a first forging die heated at 400° C. The first forging step was carried out for rough forging under the conditions of a compression speed of 200 mm/sec., a compression pressure of 10 tons/cm$^2$ and a compression ratio of 20%.

At preheating temperatures of the magnesium alloy plates between 350° C. and 500° C., box-shaped, intermediate forged products each having a bottom of 50 mm×155 mm, sidewalls of 6 mm in effective height, and a thickness of 1.2 mm in a flat plate portion were obtained without any defects and flow marks on the surface. However, when the preheating temperature was 200–250° C., sufficient metal flow did not occur, resulting in insufficient thickness reduction and the generation of defects in inner surfaces of bottom edges and corners. On the other hand, when the preheating temperature exceeded 500° C., crystal grains grew excessively to deteriorate the surface conditions of the thin forged casing, resulting in providing it with poor mechanical strength.

EXAMPLE 4

This EXAMPLE used a first forging die consisting of a lower die block having a cavity whose inner bottom edges had a radius of curvature of 0.8 mm and an upper die block having a punch portion whose shoulder had a radius of curvature of 3.5 mm, and a second forging die consisting of a lower die block having a cavity whose inner bottom edges had a radius of curvature of 0.8 mm, and an upper die block having a punch portion whose shoulder had a radius of curvature of 0.8 mm.

A thin, flat magnesium alloy plate (AZ31) of 55 mm×160 mm×1.5 mm was uniformly preheated at 400° C. in an electric furnace filled with an argon gas and placed in a first forging die heated at 400° C. The first forging step was carried out for rough forging under the conditions of a compression speed of 200 mm/sec., a compression pressure of 10 tons/cm$^2$ and a compression ratio of 20%. The resultant box-shaped, intermediate forged product had a bottom of 50 mm×155 mm, sidewalls having an effective height of 6 mm, and a thickness of 1.2 mm in a flat plate portion without any defects and flow marks on the surface.

Next, the box-shaped, intermediate forged product was heated at a temperature ranging from 200° C. to 550° C. in an electric furnace filled with an argon gas and placed in a second forging die heated at 350° C. The box-shaped, intermediate forged product was subjected to a second forging step for precise forging under the conditions of a compression speed of 50 mm/sec., a compression pressure of 10 tons/cm$^2$, and a compression ratio of about 17%.

At a preheating temperature of the magnesium alloy plate between 300° C. and 500° C., box-shaped, intermediate forged products were obtained without any defects and flow marks on the surface. Each intermediate forged product had the following size:

Bottom: 50 mm×155 mm,

Sidewalls: 6 mm (effective height),

Thickness: 1.0 mm (flat plate portion), and

Radius of curvature at inner bottom edges: about 0.8 mm.

However, when the preheating temperature was 200–250° C., sufficient metal flow did not occur, resulting in poor surface appearance and the generation of small cracks in inner surfaces of bottom edges and corners. On the other hand, when the preheating temperature exceeded 500° C., crystal grains grew excessively and the magnesium alloy was partially burned.

EXAMPLE 5

This EXAMPLE used a first forging die consisting of a lower die block having a cavity whose inner bottom edges had a radius of curvature of 1.0 mm and an upper die block having a punch portion whose shoulder had a radius of curvature of 5.0 mm, and a second forging die consisting of a lower die block having a cavity whose inner bottom edges had a radius of curvature of 1.0 mm, and an upper die block having a punch portion whose shoulder had a radius of curvature of 1.0 mm.

A thin, flat magnesium alloy plate (AZ31) of 180 mm×220 mm×0.9 mm was uniformly preheated at 450° C. in an electric furnace filled with an argon gas and placed in a first forging die heated at a temperature of 300° C., 400° C. or 450° C. The first forging step was carried out for rough forging under the conditions of a compression speed of 200 mm/sec., a compression pressure of 10 tons/cm$^2$ and a compression ratio of about 22%.

At die temperatures of 400° C. and 450° C., the resultant box-shaped, intermediate forged products were obtained without any defects and flow marks on the surface. Each intermediate forged product had the following size:

Bottom: 170 mm×210 mm,

Sidewalls: 10 mm (effective height),

Thickness: 0.7 mm (flat plate portion), and

Radius of curvature at inner bottom edges: about 1.0 mm.

However, when the die temperature was 300° C., the resultant box-shaped, intermediate forged product had partial defects.

Next, the box-shaped, intermediate forged products without defects were heated at 300° C. or 400° C. in an electric furnace filled with an argon gas and placed in a second forging die heated at 350° C. The box-shaped, intermediate forged product was subjected to a second forging step for precise forging under the conditions of a compression speed of 50 mm/sec., a compression pressure of 10 tons/cm$^2$, and a compression ratio of about 14%.

In both cases, box-shaped, thin forged casings were obtained without any defects and flow marks on the surface. Each thin forged casing had the following size:

Bottom: 170 mm×210 mm,

Sidewalls: 10 mm (effective height),

Thickness: 0.6 mm (flat plate portion), and

Radius of curvature at inner bottom edges: about 1.0 mm.

EXAMPLE 6

Figure 12:
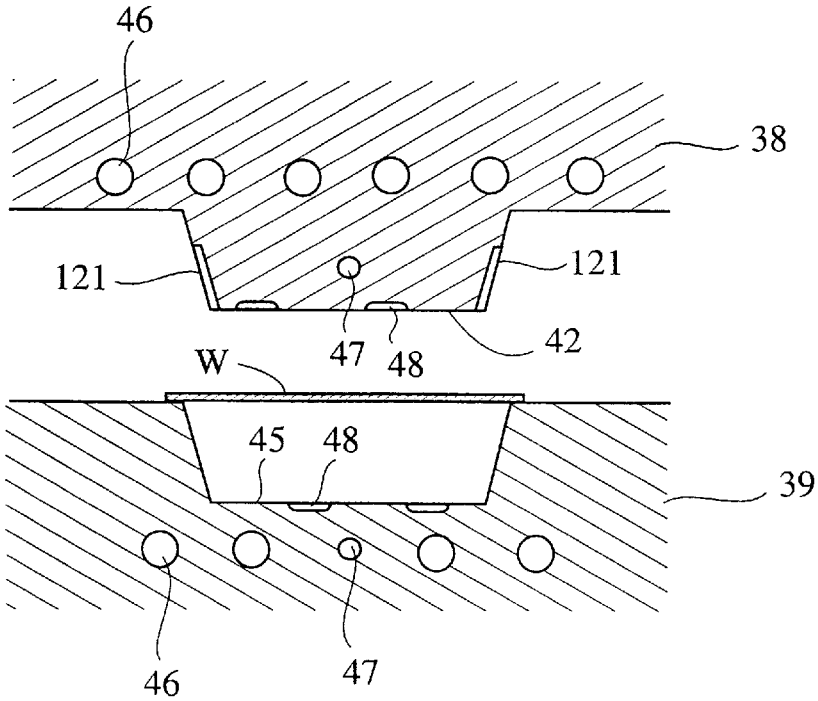
FIG. 12 is a vertical, cross-sectional view showing a pair of die blocks disposed vertically for carrying out the first forging step according to a preferred embodiment of the present invention.

This EXAMPLE used a first forging die consisting of a lower die block having a cavity whose inner bottom edges had a radius of curvature of 3.5 mm and an upper die block having a punch portion whose shoulder had a radius of curvature of 3.5 mm, and a second forging die consisting of a lower die block having a cavity whose inner bottom edges had a radius of curvature of 0.8 mm, and an upper die block having a punch portion whose shoulder had a radius of curvature of 0.8 mm. The punch portion 42 of the upper die block 38 in the first forging die was provided with four notches 121 slightly larger than 3 mm×3 mm×4 mm (depth) extending along edges from tip ends of four corners as shown in FIG. 12. The punch portion of the upper die block in the second forging die was similarly provided with four notches of 3 mm×3 mm×4 mm (depth) extending along edges from tip ends of four corners. These notches were provided to form projections for bosses.

A thin, flat magnesium alloy plate (AZ31) of 55 mm×160 mm×1.5 mm was uniformly preheated at 400° C. in an electric furnace filled with an argon gas and placed in a first forging die heated at 400° C. The first forging step was carried out for rough forging under the conditions of a compression speed of 200 mm/sec., a compression pressure of 10 tons/cm$^2$ and a compression ratio of about 20%. The resultant box-shaped, intermediate forged product had a bottom of 50 mm×155 mm, sidewalls having an effective height of 6 mm, and a thickness of 1.2 mm in a flat plate portion with four projections for bosses at inner corners. As a result of observation by the naked eye, it was found that the box-shaped, intermediate forged product was free from any defects and flow marks on the surface.

Next, the box-shaped, intermediate forged product was heated at 350° C. in an electric furnace filled with an argon gas and placed in a second forging die heated at 350° C. The box-shaped, intermediate forged product was subjected to a second forging step for precise forging under the conditions of a compression speed of 50 mm/sec., a compression pressure of 10 tons/cm$^2$, and a compression ratio of about 17%. The resultant box-shaped, thin forged casing had the following size:

Bottom: 50 mm×155 mm,

Sidewalls: 6 mm (effective height),

Thickness: 1.0 mm (flat plate portion),

Radius of curvature at inner bottom edges: 0.8 mm, and

Boss at each corner: 3 mm×3 mm×4 mm (height).

As a result of observing by the naked eye, it was found that the box-shaped, thin forged casing had an extremely uniform surface metal structure free from defects and flow marks.

EXAMPLE 7

This EXAMPLE used a first forging die consisting of a lower die block having a cavity whose inner bottom edges had a radius of curvature of 5.2 mm and an upper die block having a punch portion whose shoulder had a radius of curvature of 5.0 mm, and a second forging die consisting of a lower die block having a cavity whose inner bottom edges had a radius of curvature of 1.0 mm, and an upper die block having a punch portion whose shoulder had a radius of curvature of 1.0 mm. The punch portion of the upper die block of the first forging die was provided with four notches slightly larger than 4 mm×4 mm×6 mm (depth) extending along edges from tip ends of four corners and the same two notches at centers of longer sides. The punch portion of the upper die block of the second forging die was provided with four notches of 4 mm×4 mm×6 mm (depth) extending along edges from tip ends of four corners and the same two notches at centers of longer sides. These notches were provided to form projections for bosses.

A thin, flat magnesium alloy plate (AZ31) of 180 mm×220 mm×1.2 mm was uniformly preheated at 450° C. in an electric furnace filled with an argon gas and placed in a first forging die heated at 400° C. The first forging step was carried out for rough forging under the conditions of a compression speed of 200 mm/sec., a compression pressure of 10 tons/cm$^2$ and a compression ratio of about 42%. The resultant box-shaped, intermediate forged product had a bottom of 170 mm×210 mm, sidewalls having an effective height of 8 mm, and a thickness of 0.7 mm in a flat plate portion, with projections for bosses at four corners and centers of long sidewalls. As a result of observation by the naked eye, it was found that the box-shaped, intermediate forged product was free from any defects and flow marks on the surface.

Next, the box-shaped, intermediate forged product was heated at 350° C. in an electric furnace filled with an argon gas and placed in a second forging die heated at 350° C. The box-shaped, intermediate forged product was subjected to a second forging step for precise forging under the conditions of a compression speed of 50 mm/sec., a compression pressure of 10 tons/cm$^2$, and a compression ratio of about 14%. The resultant box-shaped, thin forged casing had the following size:

Bottom: 170 mm×210 mm,

Sidewalls: 8 mm (effective height),

Thickness: 0.6 mm (flat plate portion),

Radius of curvature at inner bottom edges: about 1 mm, and

Projection for boss*: 4 mm×4 mm×6 mm (height).

Note *: at each corner and each center of the sidewall.

As a result of observing by the naked eye, it was found that the box-shaped, thin forged casing had an extremely uniform surface metal structure free from defects and flow marks.

EXAMPLE 8

This EXAMPLE used a first forging die consisting of a lower die block having a cavity whose inner bottom edges had a radius of curvature of 2.5 mm and an upper die block having a punch portion whose shoulder had a radius of curvature of 2.5 mm, and a second forging die consisting of a lower die block having a cavity whose inner bottom edges had a radius of curvature of 0.7 mm, and an upper die block having a punch portion whose shoulder had a radius of curvature of 0.7 mm. The punch portion of the upper die block of the first forging die was provided with four notches slightly larger than 3 mm×3 mm×5 mm (depth) extending from the top surface at positions 5 mm from the corners. The punch portion of the upper die block of the second forging die was provided with four notches of 3 mm×3 mm×5 mm (depth) extending from the top surface at positions 5 mm from the corners. These notches were provided to form projections for bosses. Also, the punch portion of the upper die block of the second forging die was provided with a plurality of 0.3-mm-high steps immediately below a line corresponding to a cutaway line along which the sidewalls of the resultant thin forged casing were trimmed.

A thin, flat magnesium alloy plate (AZ31) 100 mm×100 mm×1.0 mm was uniformly preheated at 430° C. in an electric furnace filled with an argon gas and placed in a first forging die heated at 380° C. The first forging step was carried out for rough forging under the conditions of a compression speed of 200 mm/sec., a compression pressure of 10 tons/cm$^2$ and a compression ratio of 30%. The resultant box-shaped, intermediate forged product had a bottom of 95 mm×95 mm, sidewalls having an effective height of 7 mm, and a thickness of 0.7 mm in a flat plate portion, with four projections for bosses at positions 5 mm from the corners of the sidewalls. As a result of observation by the naked eye, it was found that the box-shaped, intermediate forged product was free from any defects and flow marks on the surface.

Next, the box-shaped, intermediate forged product was heated at 430° C. in an electric furnace filled with an argon gas and placed in a second forging die heated at 380° C. The box-shaped, intermediate forged product was subjected to a second forging step for precise forging under the conditions of a compression speed of 50 mm/sec., a compression pressure of 7 tons/cm$^2$, and a compression ratio of about 7%. The resultant box-shaped, thin forged casing had the following size:

Bottom: 95 mm×95 mm,

Sidewalls: 7 mm (effective height),

Thickness: 0.65 mm (flat plate portion),

Projection for boss*: 3 mm×3 mm×5 mm (height).

Note *: at points 5 mm from the corners of the sidewalls.

As a result of observing by the naked eye, it was found that the box-shaped, thin forged casing had an extremely uniform surface metal structure free from defects and flow marks.

As described above in detail, the thin, forged magnesium alloy casings of the present invention with projections on either or both surfaces are as thin as about 1.5 mm or less in flat plate portions, which has never been achieved before in the art. Because of the nature of magnesium alloys, the thin forged casings of the present invention are lighter and tougher than forged aluminum casings. In addition, the thin, forged magnesium alloy casings of the present invention are substantially free from defects and flow marks on the surface. With transparent surface coatings such as anodic oxidation coatings and clear paint coatings, the thin, forged magnesium alloy casings are corrosion-resistant with metallic glow.

The thin, forged magnesium alloy casings can be produced by forging at temperatures near the melting points of the magnesium alloys. When the compression ratio is limited to a certain level by using a thin magnesium alloy plate as a starting material, flow marks due to forging can effectively be suppressed.

The thin, forged magnesium alloy casings having such advantages are suitable for various casings of electronic appliances such as cellular phones, note-type or mobile personal computers, electronic recording media such as compact disks, minidisks, etc.

What is claimed is:

1. A thin, forged magnesium alloy casing comprising a thin plate with projections on either or both surfaces, said thin plate being as thin as 1.5 mm or less, and said thin forged casing being substantially free from flow marks on the surface thereof.

2. The thin, forged magnesium alloy casing according to claim 1, wherein said thin plate is as thin as 1 mm or less.

3. The thin, forged magnesium alloy casing according to claim 1, having sharp bottom edges and corners whose inner surfaces have radii of curvature of about 1 mm or less, and sharp projections whose shoulders have radii of curvature of about 1 mm or less.

4. The thin, forged magnesium alloy casing according to claim 1, wherein said magnesium alloy has a composition comprising 1–6 weight % of Al, 0–2 weight % of Zn and 0.5 weight % or less of Mn, the balance being substantially Mg and inevitable impurities.

5. The thin forged casing made of a magnesium alloy according to claim 1, wherein said thin forged casing is provided with a surface coating selected from the group consisting of an anodic oxidation coating and a paint coating.

6. The thin forged casing made of a magnesium alloy according to claim 1, wherein some of said projections on the inner surface are provided with screw holes.

* * * * *